US011021841B2

(12) United States Patent
Eisenreich

(10) Patent No.: US 11,021,841 B2
(45) Date of Patent: Jun. 1, 2021

(54) RAILWAY OR TRAMWAY TRACK

(71) Applicant: Jan Eisenreich, Plzen (CZ)

(72) Inventor: Jan Eisenreich, Plzen (CZ)

( * ) Notice: Subject to any disclaimer, the term of this patent is extended or adjusted under 35 U.S.C. 154(b) by 278 days.

(21) Appl. No.: 16/072,635

(22) PCT Filed: Aug. 29, 2016

(86) PCT No.: PCT/CZ2016/050030
§ 371 (c)(1),
(2) Date: Jul. 25, 2018

(87) PCT Pub. No.: WO2017/129150
PCT Pub. Date: Aug. 3, 2017

(65) Prior Publication Data

US 2019/0040587 A1 Feb. 7, 2019

(30) Foreign Application Priority Data

Jan. 26, 2016 (CZ) ..... PV2016-34

(51) Int. Cl.
*E01B 19/00* (2006.01)
*E01C 9/06* (2006.01)

(52) U.S. Cl.
CPC ..... *E01B 19/003* (2013.01); *E01C 9/06* (2013.01)

(58) Field of Classification Search
CPC . E01B 1/00; E01B 1/004; E01B 1/008; E01B 19/00; E01B 19/003; E01B 19/006; E01B 21/00; E01B 21/02; E01B 2204/00; E01B 2204/01; E01B 2204/07; E01B 2204/14
See application file for complete search history.

(56) References Cited

U.S. PATENT DOCUMENTS 4,500,037 A * 2/1985 Braitsch ..... F16F 1/376 238/2
4,703,890 A * 11/1987 Tognoli ..... E01B 29/005 238/7
4,923,118 A * 5/1990 Goossens ..... E01B 1/008 238/265
5,163,614 A * 11/1992 Tamas ..... E01B 1/008 238/2
6,764,022 B2 7/2004 Mohr et al.
7,850,089 B2 12/2010 Freudenstein et al.
(Continued)

FOREIGN PATENT DOCUMENTS

CZ 286554 3/2000
CZ 295023 3/2005
CZ 303309 7/2012
(Continued)

OTHER PUBLICATIONS

CZ Search Report, dated Oct. 25, 2016.
PCT Search Report, dated Dec. 22, 2016.

*Primary Examiner* — Robert J McCarry, Jr.
(74) *Attorney, Agent, or Firm* — Dority & Manning, P.A.

(57) ABSTRACT

A railway or tramway track includes track rails arranged on a foundation surface. Noise and vibration reduction elements are arranged between the track rails and outward of the track rails. The noise and vibration reduction elements include at least one non-humic layer that absorbs water, reduces rate of flow and outflow of the water, and allows evaporation of the water.

11 Claims, 5 Drawing Sheets

(56) References Cited

U.S. PATENT DOCUMENTS

2009/0121035 A1 5/2009 Kowalski

FOREIGN PATENT DOCUMENTS

| | | | | |
|---|---|---|---|---|
| CZ | 303755 | B6 | 4/2013 | |
| CZ | 29374 | U1 | 4/2016 | |
| DE | 3602313 | | 7/1987 | |
| DE | 29721515 | U1 | 1/1998 | |
| DE | 20116789 | U | 1/2002 | |
| DE | 102005025791 | | 12/2006 | |
| EP | 0420363 | | 4/1991 | |
| EP | 0726359 | B1 | 5/2000 | |
| EP | 1288371 | A2 | 3/2003 | |
| EP | 1836352 | A1 | 9/2007 | |
| EP | 1869253 | A1 | 12/2007 | |
| WO | WO 2005/085529 | A1 | 9/2005 | |
| WO | WO-2005085529 | A1 * | 9/2005 | ..... E01B 19/003 |

* cited by examiner

RAILWAY OR TRAMWAY TRACK

TECHNICAL FIELD OF THE INVENTION

The invention relates to a railway or tramway track with noise and vibration reduction elements arranged both inside and outside the track.

BACKGROUND

A wide variety of systems are known to reduce noise emissions and vibration from rail vehicles produced due to the contact between the wheel and the rail. These systems are most often based on the structural configuration of a rail fastening system and on a high quality, i.e. smooth finish, of the contact surfaces of the wheel and the rail. However, it is also the construction of rail vehicles as such and the construction of the railway itself that is the source of noise and vibration. At high speeds of the trains, noise and vibration are caused by the aerodynamic design of railway vehicles, etc.

During the construction of railways, it is essential to increase the overall stability of the railway operated in time, to ensure minimum variations in the precise design of the track geometry, to reduce maintenance costs and thus reduce time loss caused by planned engineering works when trains are replaced by buses, which leads to the construction of solid railways. These railways do not contain gravel ballast, which would otherwise absorb noise and vibration in the railway track. Therefore, these solid railways have higher emissions of noise and vibration into the surrounding area than gravel ballasted tracks. Known arrangements of solid railways are described, for example, in the European patent application No. 02015816.8 (EP 1288371 A2) entitled "Balastless track with at least one monoblock sleeper", in the European patent application No. 06722496.4 (EP 1869253) entitled "Solid railway for track vehicles, and method for the production thereof", in the European patent application No 06805409.7 (EP 1836352) entitled "Fixed track bed for rail vehicles", and others.

So as to prevent the propagation of noise and vibration from the rail track into the surrounding area, vertical noise barriers are most commonly used, whereby these noise barriers are made of boards or panels placed along the railway or tramway track, or horizontal structural pads of the track space made from materials absorbing noise and vibration are used, or a combination of both types of measures can be used.

One of the solutions known so far relating to the horizontal anti-noise pads in railways with a solid carriageway uses modular panels with interlocked edges and with vertical chambers. These modular panels are manufactured from porous, noise absorbing materials, e.g., materials based on wood fillers, wood shavings, etc., and are cement bonded. The modular panels are laid flat between the rails and also outside the track on a concrete slab of the solid railway construction and are bonded or mechanically anchored against moving or lifting. However, the disadvantage of this system is the fact that they can be hardly used on a railway with transverse railway sleepers and gravel ballast.

Another known solution of a railway track for noise and vibration mitigation is disclosed in the patent No. CZ 286 554 and consists especially in horizontal filling of the space between the rails with elastomeric components in the system of laying the rails and wrapping them with elastomeric components. On the horizontal elastomeric components is installed a layer of soil and growing medium for planting grass seed.

CZ PV 2000-3667 (CZ 295 023) discloses a solution of a railway track for reducing noise and vibration, which consists particularly in wrapping the rail with bandage from elastomeric materials absorbing vibration and noise.

On the other hand, the solution for reducing the propagation of vibration and noise by forming a compact horizontal pad filling the space between the rails and between the tracks with elastomeric and noise-absorbing elements and/or cultivation layers, especially organic layers with grass or other appropriate plants makes it difficult or completely impossible to perform the control system of rail fastening and to carry out the maintenance of the geometry of the gravel-ballasted tracks by means of tamping. During the maintenance of rail fastenings and the maintenance of the rails by tamping, it is therefore necessary to dismantle completely the structural layers, which results in partial, but in most cases complete, deterioration of these layers and consequently they have to be replaced with new ones.

Regarding railway tracks leading through urbanized (populated) areas, which form the so-called urban heat islands—referred to as UHI, the most commonly used conventional arrangement of the track is an arrangement formed by a grid of rails with transverse supports, sleepers, mounted in the gravel ballast on the railway substructure or plain. From the point of view of the environment and climate change, the areas of rail tracks with different surfaces have an impact on the energy balance of the urban environment and atmospheric composition. Tall urban buildings with a prevalence of vertically oriented surfaces lead to an increase in the amount of shortwave radiation and to its reflection into the adjacent space and thereby they have a negative impact on the climate, causing an increase in local temperature, reducing humidity, affecting wind speed and direction, influencing rainfall in a given area, etc.

In the townscape, railways constitute important areas with a significant impact on the environment and the urban climate, and therefore the railway tracks are often built in the form of the so-called "green tracks" which are used to improve the environment of the urban climate. In the "green tracks", the railyard area is covered with natural vegetation, mostly grass. However, known technologies for construction of such railway lines require the formation of a top organic soil cover of the track structure to ensure living conditions for the grown plants. Any repair of the track then requires extensive "building-agricultural" activities associated with excavation work and re-inserting a new soil cover into the track construction, as well as restoration of the grass cover. Also, the soil cover itself has to be always separated from the constructional part of the railway track, i.e. the rail grid or the gravel ballast, in order to prevent the soil cover from penetrating into the rail grid or the gravel ballast, which would be negatively affected by this or might be even deteriorated. Moreover, the soil cover consists of organic components, which are gradually consumed by the growing plants and the structure of the soil cover is gradually becoming denser and, as the case may be, it may also become compacted due to the driving rail vehicles, which results not only in decreasing the vegetative abilities of the plants, but also in reducing the ability of such a soil layer to retain water. Changes in the water absorption capacity of the soil cover of the track and changes in the homogeneity of the structural layers of the track may, during torrential rains or during times of prolonged rainy periods, even lead to soil erosion and to dangerous undermining of the track grid, which negatively affects the quality and safety of the railway track. The current constructions of green tracks with a soil cover and natural lawns also require abundant irrigation and supply of nutrients for the plants, whereby the irrigation water must be relatively clean because it is used and evaporated in a residential area. Properly maintained natural lawns on the soil cover of railway tracks are always economically challenging, and these costs are covered largely by public budgets.

Thus, the currently promoted arrangement of railway tracks in actual fact requires continuous arrangement of the railway substructure and superstructure to maintain the same stiffness of the track structure in the longest possible section. Related to this is also the issue of requirements for reducing emissions and noise and vibration propagation both into the surrounding open spaces and within the space of a rail vehicle. In addition to these requirements for technical solution of the track structure, it is highly desirable for the structures for reducing noise and vibration propagation to be embedded in a simple manner both in the tracks with a conventional track grid and gravel ballast and in the tracks with a solid railway composed of concrete planar components with flexibly mounted rails. In terms of the environmental requirements, the current rail tracks should ensure improved water retention at the site and decreased water drainage and should allow its evaporation at the site.

Nevertheless, these requirements can be met by the known systems only to a considerably limited extent, or fulfilling them involves considerable additional costs so as to maintain all the functions of the systems, especially the functions of the green track.

The aim of the invention is to eliminate, or at least minimize, the disadvantages of the background art, especially to allow the building of railway tracks with a continuous arrangement of the railway substructure and superstructure so as to maintain the same stiffness of the track in the longest possible section, while reducing effectively noise and vibration levels and allowing to build the so-called green tracks with reduced maintenance costs of green areas, i.e. with improved water retention and evaporation in the track area.

SUMMARY OF THE INVENTION

Objects and advantages of the invention will be set forth in part in the following description, or may be obvious from the description, or may be learned through practice of the invention.

The aim of the invention is achieved by a railway or tramway track, whose principle consists in that noise and vibration reduction elements contain at least one non-humic layer, which absorbs water, reduces its rate of flow and outflow, and allows its evaporation. The non-humic layer is a part of inner components inserted between the rails and/or it is a part of outer components arranged along both outer sides of the rails and/or is composed of at least retention plates, which are inserted between the rails and/or are arranged along at least one outer side of the rails.

The advantage of the proposed solution is the fact that it can be used both on the tracks with a conventional railway superstructure composed of rails, transverse sleepers and gravel ballast, and on railways with a solid railway composed of rails and a concrete slab without gravel ballast. The solution can be preferably used also on railway tracks leading on bridge constructions, where it can at the same time create escape routes for passengers and operating staff in case of accidents or emergencies.

The inner components and outer components as such are formed by a very subtle firm plate, modified in its shape, usually made from high quality concrete with an inserted noise absorbing and retention pad, which most typically consists of a sound-absorbing recyclate from synthetic materials or stone agglomerate or wad. The sandwich component thus created is on the side adjacent to the rail provided with spatial recesses which enable to mount it in a track with rail fastening systems and to fix it in the track. Similarly, this is the case with an embodiment having a retention plate as a self-carrying body.

In a preferred embodiment, the inner components, outer components and retention plates in the track are secured with the aid of clamp resilient stabilizers, which are made of an elastomer and at the same time damp the noise and vibration coming from the space of the coupling chamber of the rail and/or the flange of the rail, whereby optionally a part of the body of the stabilizer is provided with a continuous shape recess and/or a less rigid material with a higher level of flexibility is used. Such an embodiment of the stabilizer ensures different values of stiffness of the systems of modular components for reducing noise and vibration in the track than is the stiffness of the system of the rail track, especially of the system of the tracks with their fastenings. The transverse stiffness of the stabilizers is therefore appropriately adjusted so that it is smaller than that of the track fastenings mounted in the rail fastening systems. Mounting the inner and outer sandwich components, or retention plates, in a track with a solid railway with stabilizers disposed between the individual rail fastening systems allows visual inspection of these systems and does not block possible repair in case the system is damaged or becomes loose, etc. Between the individual inner and outer components, there are joint gaps at given distances, thus ensuring a nonhomogeneous and electrically insulated split system of components joining one another. The individual stabilizers do not contact each other, by which means they form a non-homogeneous and electrically insulated split system of elastomeric components.

In another preferred embodiment of the invention, the inner and outer sandwich components, or retention plates, are mounted into the entire space between the continuous stabilizers filling the coupling chamber of the rails, whereby these stabilizers fulfill a sound-absorbing and anti-vibration function. The stabilizers are preferably made from recycled rubber chippings and are water-permeable. In another preferred embodiment, the stabilizers are made by pressing at least two different layers of recycled rubber together.

According to a preferred embodiment, the upper surface of the noise and vibration reduction elements is covered by a humic layer with a vegetation cover, which is most commonly formed by different varieties of grass or sedum.

In another preferred embodiment of the invention, the upper surface of the noise and vibration reduction elements is covered with an artificial grass carpet mechanically attached to the surface of the noise and vibration reduction elements and/or bonded to the supporting part of the noise and vibration reduction elements.

In a preferred embodiment, the noise and vibration reduction elements are separated on the outer side of the rail from the surroundings of the track by dividing prefabricated components, whereby the noise and vibration reduction elements tightly abut the dividing prefabricated components. Also, these dividing prefabricated components may be provided on its inner or outer surface with an elastomeric layer preventing vibration propagation.

According to one embodiment, the non-humic layer is composed of water-absorbing and water-permeable synthetic clumps. According to another embodiment, the non-humic layer is composed of water-permeable porous agglomerate from inert, non-absorptive materials.

In order to improve water retention, the noise and vibration reduction elements contain shape recesses in their bottom area to hold water and/or to allow drainage from the element.

So as to improve bearing capacity, the inner and outer components contain vertical thin-walled bearing stiffeners.

In terms of the mounting process and functionality it is advantageous if the retention plates are mounted loosely on top of each other, being overlapped by at least ⅓ of their size, and optionally they are covered by at least one layer of a system of separation plates.

According to a preferred embodiment, the non-humic layer is planted by plants.

DESCRIPTION OF THE DRAWINGS

The invention is explained with reference to figures of exemplary embodiments, which are schematically represented in the following drawings.

DETAILED DESCRIPTION

Figure 1:
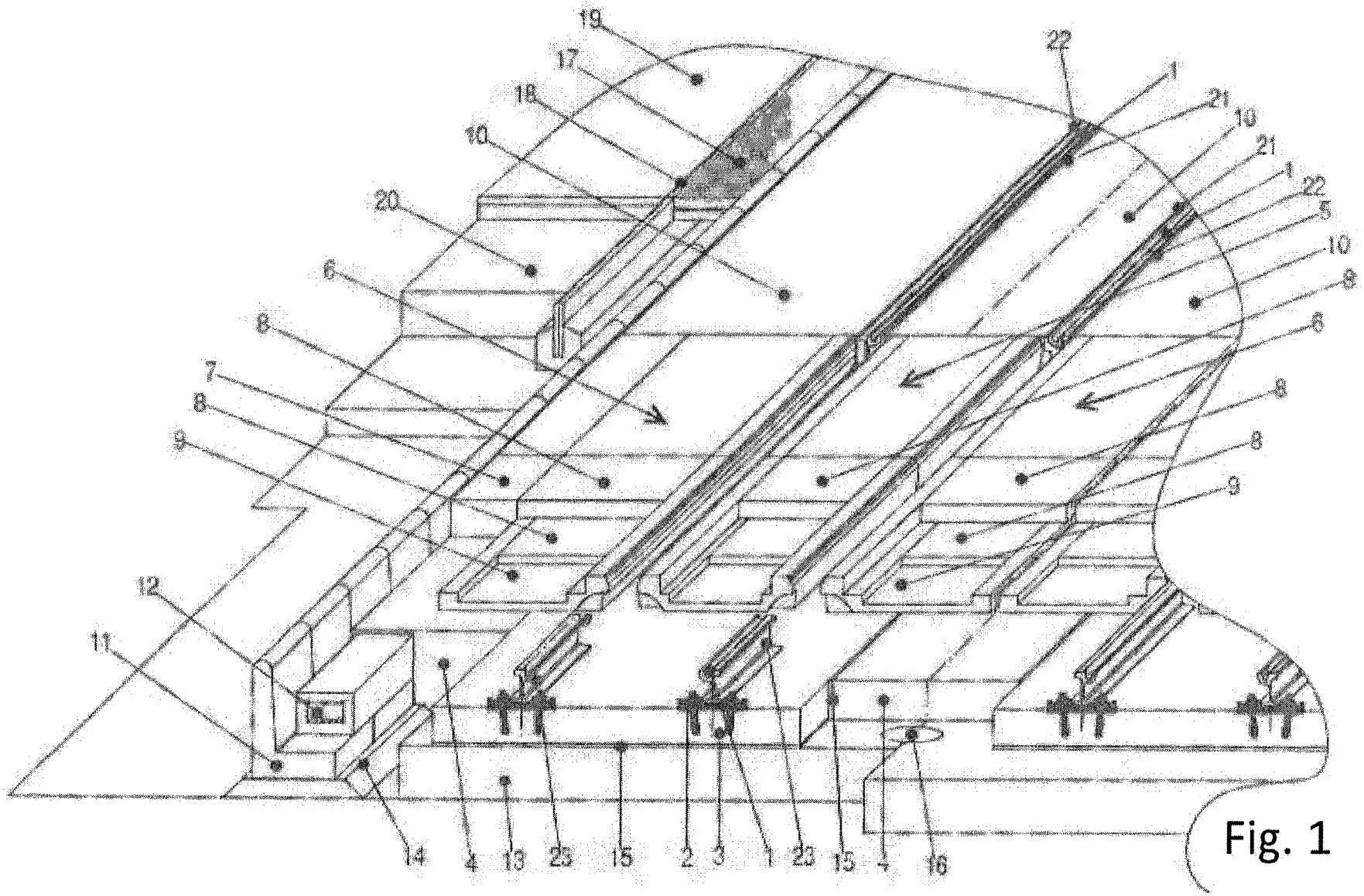
FIG. 1 is a schematic axonometric view from the front in partial section of an embodiment of a railway track with modular elements for reducing noise and vibration with the function of water retention according to the invention, containing a solid railway and systems of inner and outer components with their surface composed of an artificial grass carpet.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Several embodiments will be used to explain the invention, illustrated in FIGS. 1 to 5, whereby the principle of the invention is based on the fact that at least one non-humic layer is inserted in the track, whereby this layer absorbs water, reduces its rate of flow and outflow, and at the same time allows its evaporation. By the non-humic humic layer, we understand a layer which does not contain soil, or, more specifically, soil for growing plants.

FIG. 1 shows an exemplary embodiment, where the railway or tramway track comprises a solid railway 3, usually composed of a reinforced concrete slab with rails 1, which are mounted in fastening systems 2, whereby the concrete slab with rails 1 is mounted on the underlying construction 13 of the track. The distance of the axes of the fastening systems 2 is determined by a respective regulation, most often being in the range from 600 to 800 mm.

Inside the track, i.e. between the rails, are mounted inner components 5 in the direction of the length of the track and outside the track, i.e. along the outer sides of the rails 1, are mounted outer components 6 in the direction of the length of the track. Between the individual inner components 5 there are unmarked joint gaps, which have a constant width in the case of a straight track and a varying width in the case of a curved track or track transition curve. Between the individual outer components 6 there are unmarked joint gaps, which have a constant width in the case of a straight track and a varying width in the case of a curved track or track transition curve.

The inner components 5 and outer components 6 contain a supporting part 9 in the form of the letter "U", whose shape is modified according to the embodiment of the track and is mounted on the body of the track, whereby in the inner part, i.e. between the lateral walls of the supporting part 9 are permanently inserted sandwich layered retention and damping pads 8 from a highly absorbent, water-permeable material. The inner components 5 and outer components 6 are always situated between the individual fastening systems 2 of the rails 1.

The inner components 5 and outer components 6 are on the entire ground area covered with an artificial grass carpet 10, which is either mechanically attached to them and/or is bonded to them.

According to a preferred embodiment, the retention and damping pads 8 consist of a recycled wadding synthetic material, e.g., the material available under the trade name STERED, which is manufactured according to SK UV 6673, where the density of the individual parts of the sandwich layering of the retention and damping pads 8 determines not only specific retention and damping capabilities of a specific embodiment of the inner components 5 and outer components 6, but also their mechanical bearing capacity, e.g. for creating mechanically more resistant surfaces.

In an unillustrated embodiment, the retention and damping pads 8 are reinforced by supporting ribs, made most typically from high-quality concrete, which are occasionally drivable by wheeled vehicles of track maintenance, etc., or are also drivable by road vehicles on the surface of the railway track. In another unillustrated embodiment, the retention and damping pads 8 are composed of special sound-absorbing porous concrete made from gravel or similar agglomerates based on recycled concrete or bricks.

In the coupling chamber 23 of the rails 1 are continuously mounted damping stabilizers from a water-permeable elastomer, whereby inner stabilizers 21 are situated inside the track and outer stabilizers 22 are situated outside the track. The stabilizers 21 and 22 are either bonded to the rail 1, or they are constantly pressed against the rail 1 by means of unillustrated shape protrusions or locks on the lateral side of the inner components 5 and the lateral side of the outer components 6. In another preferred embodiment, the inner damping stabilizer 21 contains a longitudinal shape recess for creating a groove for a wheel flange of a railway vehicle.

Figure 5:
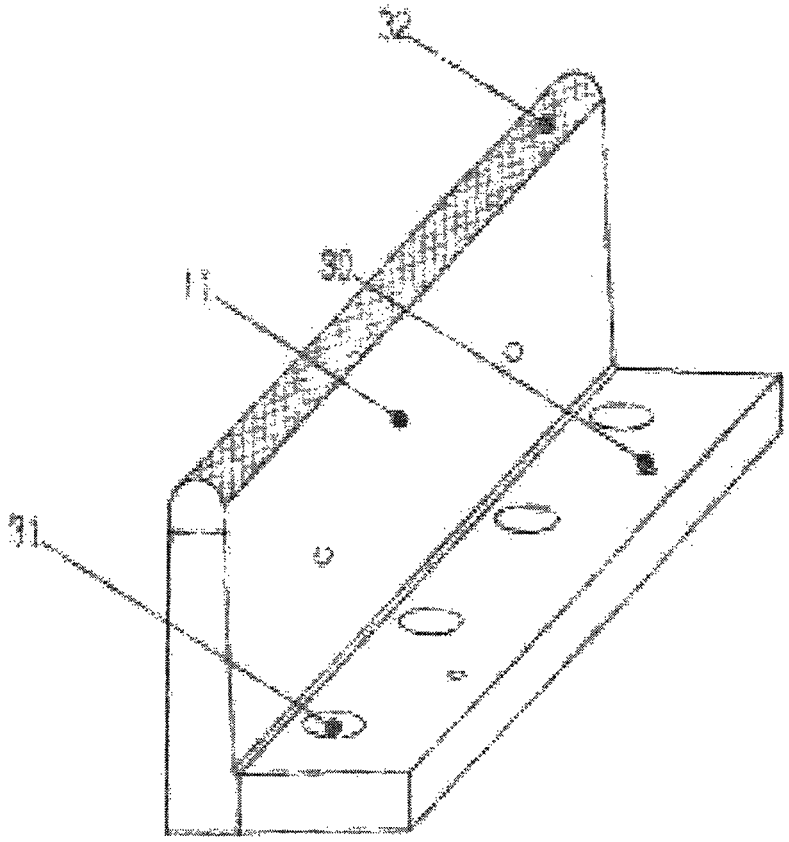
FIG. 5 is a schematic axonometric view from the front of an embodiment of a dividing prefabricated component.

In an illustrated embodiment, outside the rail track are mounted on the underlying foundation layer 14 dividing prefabricated components 11 shaped in the form of the letter "L", see FIG. 5, whereby the height of these dividing prefabricated components 11 depends on the type and embodiment of the adjacent areas, namely the adjacent natural lawn 17 or on the adjacent construction of the carriageway 19 etc. In one embodiment, the height of the dividing prefabricated components 11 is such that the rounded upper portion 32 of the prefabricated component extends above the level of the rail track and the adjacent area, thus forming a visual dividing strip between the railway track and the adjacent area, e.g., between the rail track and the construction of the carriageway 19.

Figure 2:
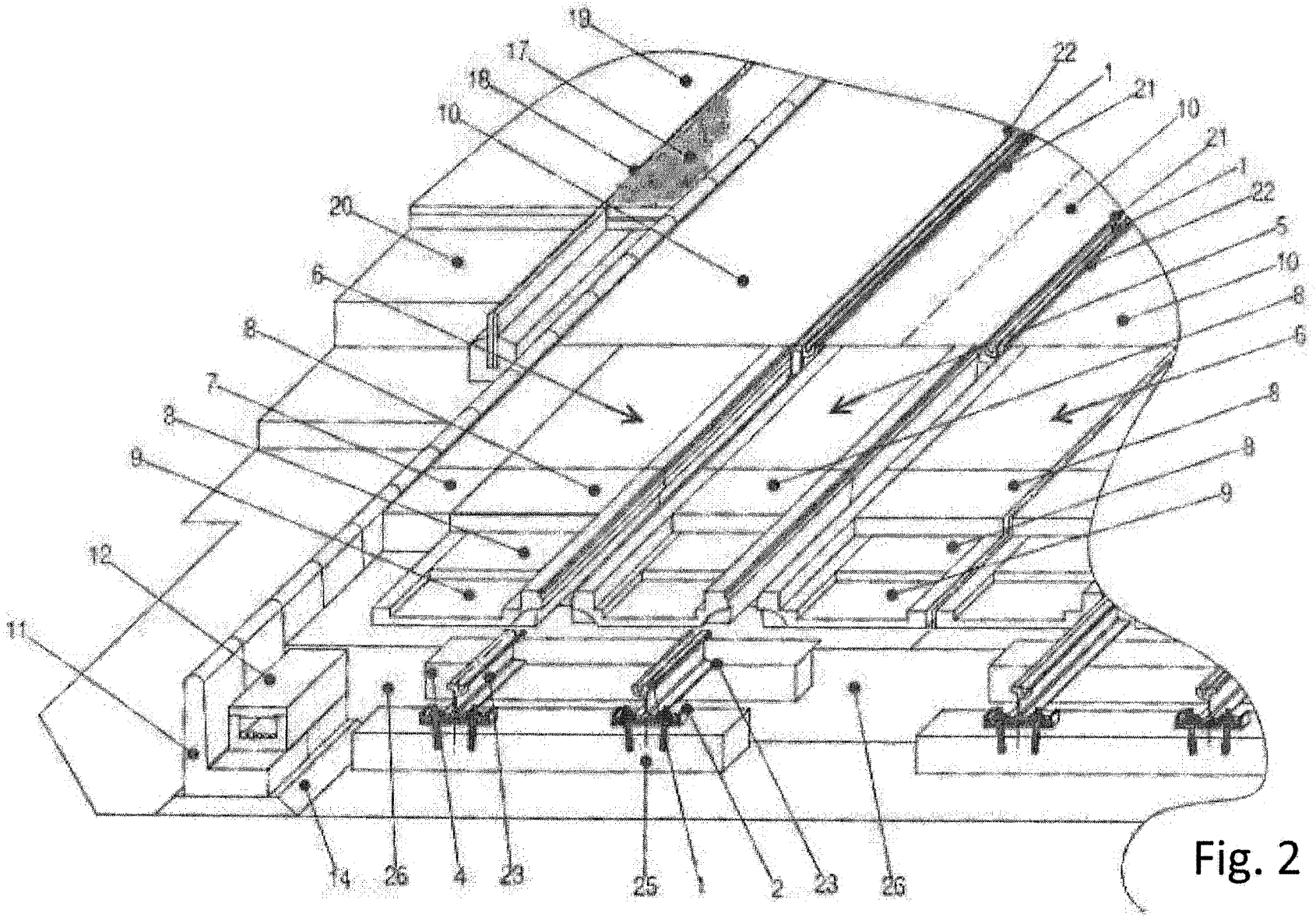
FIG. 2 is a schematic axonometric view from the front in partial section of an embodiment of a railway track with noise and vibration reduction modular elements with the function of water retention according to the invention, containing gravel ballast and transverse sleepers and systems of inner and outer components with their surface composed of an artificial grass carpet.

FIG. 2 shows the railway or tramway track from FIG. 1, which is modified by the fact that it contains rails 1, which are mounted in the fastening systems 2 and on transverse sleepers 25 forming a track grid, which is mounted on the gravel ballast 26, mounted on the not-represented construction of the subgrade construction of the track containing a system for draining the earth plain. Inside the track, i.e. between the rails 1, are mounted the inner components 5 in the direction of the length of the track, and outer components 6 are mounted outside the track, i.e. along the outer sides of the rails 1 in the direction of the length of the track. The length of the components 5 and 6 is a multiple of the axial distance of the fastening systems 2.

Figure 3:
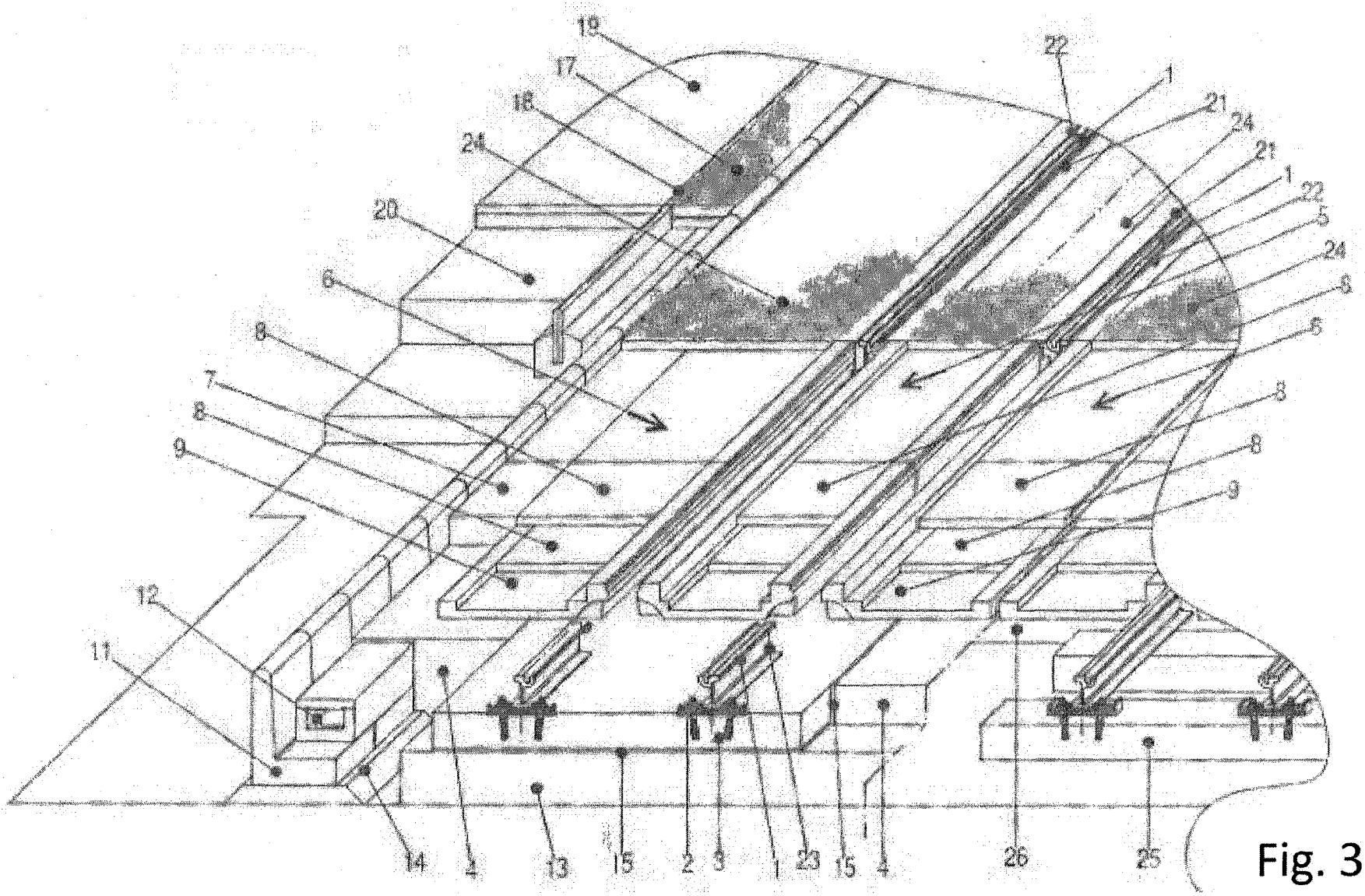
FIG. 3 is a schematic axonometric view from the front in partial section of an embodiment of a railway track with noise and vibration reduction modular elements with the function of water retention according to the invention, containing a solid railway and systems of inner and outer components containing a top humic layer with a vegetation cover.

FIG. 3 shows the railway or tramway track from FIGS. 1 and 2, which is modified by the fact that the individual outer and inner components 6, 5 contain on their upper surface a humic layer 24 for a vegetation cover consisting most often of a lawn or sedum. The supporting part 9 of the inner and outer components 5, 6 on the side adjacent to the rail 1 ends above the level of the retention and damping pads 8 and is positioned at the level of the surface of the rail 1, thus separating the humic layer 24 from the rail 1. In an unillustrated example of embodiment, the humic layer 24 is reinforced by honeycomb plastic components, e.g. to increase the bearing capacity of the surface for the purpose of the rail track being drivable by light road vehicles, e.g. by maintenance vehicles, etc.

Figure 4:
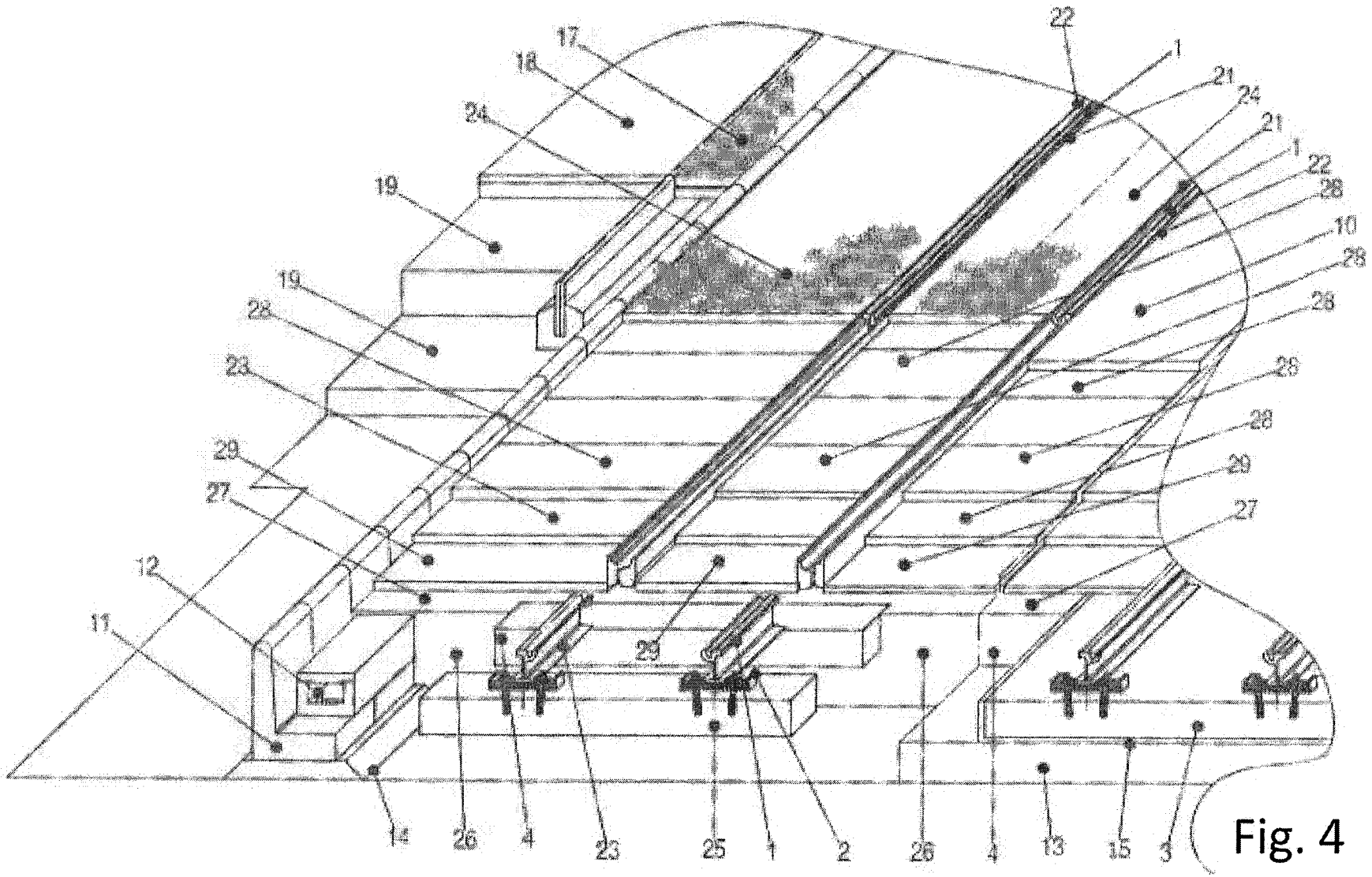
FIG. 4 is a schematic axonometric view from the front in partial section of an embodiment of a railway track with noise and vibration reduction modular elements with the function of water retention according to the invention, containing gravel ballast, transverse sleepers and individual separation and/or retention plates and a top humic layer for a vegetation cover.

FIG. 4 shows the railway or tramway track from FIGS. 1 and 2 comprising either a solid railway 3 or a rail track formed by rails 1 fastened on transverse sleepers 25 on gravel ballast 26, whereby both inside and outside the track layers of separation plates 28 and retention plates 29 are sandwich structured, ensuring noise and vibration mitigation and water retention. The individual plates 28, 29 of the sandwich arrangement are mounted in layers, most preferably being overlapped by a part of its size, e.g. by ⅓ of its size, that is in such a manner that the plates 28, 29 of the individual layers cover one another so that there are no vertical joint gaps along the entire height of the system of plates 28, 29 and consequently the overall stiffness of the structure is increased. Alternatively, the retention plates 29 of the individual layers are mounted under and/or are covered with at least one layer of separation plates 28. On the plates 28 and 29 is either arranged an upper humic layer 24 with a vegetation cover, most typically a lawn or sedum, or the retention plates 29 extend up to the upper level of the head of the rails 1 and their entire surface both inside and outside the track is covered with an artificial grass carpet 10, which is mechanically attached and/or bonded to the retention plates 29.

The separation and retention plates 28, 29 consist of a recycled wadding synthetic material, e.g. under the trade name STERED, which is manufactured according to SK UV 6673, where the density of the individual separation and retention plates 28, 29 determines not only specific retention and damping capabilities of the system of separation and retention plates 28, 29, but also their mechanical resistance, e.g. for creating mechanically more resistant surfaces.

Similarly to the embodiment in FIG. 3, the humic layer 24 with a vegetation cover is in a preferred embodiment reinforced by honeycomb plastic components to increase the resistance of the surface for the purpose of the rail track being driven by light road vehicles, etc.

Preferably, the above-mentioned dividing prefabricated component 11 contains in its lower part adjustment screws 30 for precise positioning and optionally it also contains at least one spatial recess 31 for monolithization with the underlying foundation layer 14.

Basically, it is obvious that the retention and damping pads 8 and the retention plates 29 form the so-called non-humic layer, i.e. a layer without a natural content of soil or soil components, i.e. the noise and vibration reduction elements contain at least one non-humic layer, which absorbs water, reduces the rate of its flow and outflow and allows its evaporation.

In an unillustrated embodiment, the non-humic layer is used only in one element of the whole system or only in several respective elements of the system or it is a part of all the respective elements of the system, i.e. is a part of the inner components 5 inserted between the rails 1 and/or the outer components 6 arranged along both outer sides of the rails 1 and/or it is composed of at least retention plates 29, which are inserted between the rails 1 and/or are arranged along at least one outer side of the rails 1.

INDUSTRIAL APPLICABILITY

The invention can be preferably used for building railway and tramway tracks in town residential areas, in areas of nature reserves and on bridge constructions. A combination of this solution with known low directional barriers and modular components further increases the overall efficiency of the attenuation of the noise and vibration from wheel/track contact and considerably improves water retention in the track without compromising rail operation.

Modifications and variations can be made to the embodiments illustrated or described herein without departing from the scope and spirit of the invention as set forth in the appended claims.

LIST OF REFERENCES

1 Rail
2 Rail fastening system
3 Solid railway
4 Gravel hopper
5 Inner component
6 Outer component
7 Intermediate component
8 Damping and retention pad
9 Supporting part of the component
10 Artificial grass carpet
11 Dividing prefabricated component
12 Cable guideway

13 Underlying construction of the solid railway
14 Underlying foundation layer
15 Anti-vibration mat
16 Back drain
17 Natural lawn
18 Curb
19 Construction of the carriageway
20 Underlying layers of the carriageway
21 Inner resilient stabilizers
22 Outer resilient stabilizers
23 Coupling chamber of the rail
24 Humic layer with vegetation cover
25 Transverse sleeper
26 Gravel ballast
27 Separation foil
28 Separation plate
29 Retention plate
30 Adjustment screws
31 Spatial recess for monolithization
32 Curvature

The invention claimed is:

1. A railway or tramway track, comprising:

track rails arranged on a foundation surface;

noise and vibration reduction elements arranged between the track rails and outward of the track rails;

the noise and vibration reduction elements comprising at least one non-humic layer that absorbs water, reduces rate of flow and outflow of the water, and allows evaporation of the water, the non-humic layer comprising clumps of synthetic material or an agglomerate of inert porous material formed into one or more plate structures that both absorb and pass water therethrough;

wherein the non-humic layer is a part of inner components inserted between the track rails and outer components arranged along both outer sides of the track rails, or retention plates inserted between the track rails and along at least one outer side of the track rails; and further comprising prefabricated dividing components abutting against the noise and vibration reduction elements along the outer sides of the track rails to separate the noise and vibration reduction elements from surrounding areas.

2. The railway or tramway track according to claim 1, wherein the inner and outer components comprise vertical, thin-walled supporting stiffeners.

3. The railway or tramway track according to claim 1, wherein the retention plates are loosely laid on top of an overlapping each other.

4. The railway or tramway track according to claim 1, wherein the inner components, the outer components, and the retention plates are secured in the track by resilient stabilizers that dampen noise and vibration from the track rails.

5. The railway or tramway track according to claim 4, wherein the resilient stabilizers are pressed against the track rails by shape protrusions or locks, or are bonded to the track rails.

6. The railway or tramway track according to claim 4, wherein the resilient stabilizers adjacent an inner side of the track rails comprise a longitudinal recess at a level of a head of the track rails to accommodate a wheel flange of a railway vehicle.

7. The railway or tramway track according to claim 1, further comprising a covering of an artificial grass carpet over the noise and vibration reduction elements.

8. The railway or tramway track according to claim 1, further comprising a covering of humic layer with a vegetation cover over the noise and vibration reduction elements.

9. The railway or tramway track according to claim 1, wherein the prefabricated dividing components comprise a curvature at an upper portion with an apex that is vertically higher than the adjacent rail track or vertically higher than an artificial grass carpet covering the noise and vibration reduction elements.

10. The railway or tramway track according to claim 1, wherein the prefabricated dividing components comprise adjustment screws in a lower portion thereof for precise positioning outward of the track rails.

11. The railway or tramway track according to claim 1, wherein the noise and vibration reduction elements comprise recesses in a bottom thereof configured to hold water or allow water to flow out.

* * * * *